US005390847A

United States Patent [19]

Young

[11] Patent Number: 5,390,847

[45] Date of Patent: Feb. 21, 1995

[54] FRUIT AND PRODUCE CONTAINER

[76] Inventor: Thomas R. Young, 1535 E. Orangewood, #118, Anaheim, Calif. 92803

[21] Appl. No.: 150,431

[22] Filed: Nov. 9, 1993

Related U.S. Application Data

[63] Continuation-in-part of Ser. No. 45,756, Apr. 8, 1993, Pat. No. 5,335,884, which is a continuation-in-part of Ser. No. 932,892, Aug. 19, 1992, Pat. No. 348,607.

[51] Int. Cl.[6] ..... B65D 5/32

[52] U.S. Cl. ..... 229/23 R; 229/125.29; 229/916; 229/918; 493/84; 493/102; 493/114; 493/906

[58] Field of Search ..... 229/23 R, 125.29, 164, 229/915, 916, 919; 493/84, 102, 114, 75, 76, 906

[56] References Cited

U.S. PATENT DOCUMENTS

| | | | |
|---|---|---|---|
| 2,460,870 | 2/1949 | Bruckhauser | 229/23 R |
| 2,657,849 | 11/1953 | Paul et al. | 229/915 |
| 3,409,203 | 11/1968 | DuBarry, Jr. | 229/23 R |
| 3,428,234 | 2/1969 | DuBarry, Jr. | 229/23 |
| 3,428,234 | 2/1969 | DuBarry, Jr. | 229/23 R |
| 3,486,680 | 12/1969 | Negus, Jr. | 229/125.29 |
| 3,850,362 | 11/1976 | Stollberg et al. | 229/41 |
| 3,863,831 | 2/1975 | Wozniacki et al. | 229/916 |
| 3,937,390 | 2/1976 | Winkler | 229/915 |
| 4,068,794 | 1/1978 | Lawrence | 229/23 |
| 4,175,691 | 11/1979 | Cornell et al. | 229/23 R |
| 4,341,338 | 7/1982 | Arnold, deceased | 229/23 |
| 4,389,013 | 6/1983 | Hall et al. | 229/45 |
| 4,685,610 | 8/1987 | Carter et al. | 229/23 |
| 4,911,356 | 3/1990 | Townsend et al. | 229/166 |
| 5,038,998 | 8/1991 | Morris et al. | 229/23 |
| 5,143,278 | 9/1992 | Petriekis et al. | 229/23 |

FOREIGN PATENT DOCUMENTS

| | | | |
|---|---|---|---|
| 510790 | 10/1992 | European Pat. Off. | 229/915 |
| 808228 | 2/1937 | France . | |
| 76393 | 8/1961 | France . | |
| 1534447 | 6/1968 | France . | |
| 2240156 | 3/1975 | France | 229/916 |
| 2381668 | 9/1978 | France | 229/915 |
| 4003104 | 8/1991 | Germany | 229/125.29 |
| 332687 | 10/1958 | Switzerland | 229/125.29 |
| 1097878 | 1/1968 | United Kingdom . | |

*Primary Examiner*—Gary E. Elkins
*Attorney, Agent, or Firm*—Stetina Brunda & Buyan

[57] ABSTRACT

An improved fruit and product container has a bottom and two side walls formed of a common piece of corrugated cardboard and two end walls formed of laminated paperboard attached to the bottom and side walls so as to define a box. The two laminated paperboard end walls enhance the stacking strength and moisture resistance of the container. Optionally, a top removably attaches to stacking alignment tabs extending upwardly from the end walls.

35 Claims, 3 Drawing Sheets

FRUIT AND PRODUCE CONTAINER

RELATED APPLICATIONS

The present patent application is a continuation-in-part application of U.S. patent application Ser. No. 08/045,756, filed on Apr. 8, 1993, now U.S. Pat. No. 5,335,884, issued Aug. 9, 1994; and entitled FRUIT AND PRODUCE CONTAINER, which is a continuation-in-part application of U.S. patent application Des. Ser. No. 07/932,892, filed on Aug. 19, 1992, now U.S. Pat. No. D 348,607, and entitled FRUIT AND PRODUCE CONTAINER, the contents of both of which are hereby incorporated by reference.

FIELD OF THE INVENTION

The present invention relates generally to containers and more particularly to an improved fruit and produce container used to store and transport fruit, produce, and the like.

BACKGROUND OF THE INVENTION

Containers for transporting fruit and produce, such as grapes and the like, from the fields where they are grown to markets where the fruit or produce is purchased by consumers, are well known. Such containers are generally formed of either wood or corrugated cardboard. Wood containers resist degradation due to handling and/or moisture absorption substantially better than those formed of corrugated cardboard and are thus structurally superior thereto.

However, the cost of shipping produce is proportional to the weight thereof, including the container. The use of the heavier wood containers therefore results in substantially greater shipping expense. As such, because wood containers are substantially heavier than corrugated cardboard containers, the cost to ship produce contained therein is substantially greater.

Additionally, wooden containers are comparatively more expensive to manufacture than corrugated cardboard containers. Reuse of wood containers is prohibited because wood absorbs harmful bacteria which cannot be efficiently removed therefrom. Furthermore, wood containers cannot be recycled, whereas corrugated cardboard produce containers can be recycled into various paper products.

Because the cost of storage and shipping of fruit and produce is, at least in part, further determined by the amount of floor space occupied thereby, it is commonly necessary that containers be configured in relatively high stacks so as to minimize the floor space occupied thereby. Thus, it is necessary that such containers possess sufficient structural strength to support the weight of those containers stacked above.

When corrugated cardboard containers are stacked, it is common for lower stacked corrugated containers to splay or spread apart such that at least some of the four corners of those containers stacked above tend to slide into the lower containers and thereby damage the produce contained therein. Also, degradation of such lower containers frequently results in collapse of the entire stack, thereby further increasing the amount of damage to the fruit or produce contained therein. Thus, it is desirable that the structural integrity of such containers be maintained so as to prevent damage to the contents of such containers.

Transportation of the fruit and produce containers commonly exposes them to moisture which tends to deteriorate or degrade the containers, particularly those comprised of corrugated cardboard. Handling of the containers during the loading and unloading processes subjects them to impacts which may cause damage thereto. Wetted corrugated cardboard containers are particularly susceptible to such damage.

Also, when a vehicle transporting the containers turns, the inertia of the containers tends to cause the stacks to twist or sway, thereby increasing the forces applied thereto, particularly to those containers at or near the bottom member of the stack. Such forces may thus cause damage to the stacked containers. Wetted corrugated cardboard containers are particularly susceptible to such damage.

The fruit or produce contained within such stored and/or transported containers is frequently wet. Fruit and produce may be picked wet or may sweat and thereby release moisture during shipping and storage. Also, ambient moisture may condense upon the product and/or container. Such ambient moisture is typically absorbed by corrugated cardboard containers, thus causing structural degradation thereof.

Although it is known to add plastic reinforcements to contemporary corrugated cardboard containers, the use of such plastic reinforcements presents certain inherent problems. For example, the plastic reinforcements must be purchased and then installed in the corrugated cardboard cartons prior to their use, thus adding to the cost thereof. Additionally, in order to facilitate recycling of the cardboard comprising the corrugated cardboard cartons, the plastic reinforcements must be removed therefrom. Removal of the plastic reinforcements from the corrugated cardboard cartons is labor intensive and thus adds substantially to the costs associated with their use.

Prior art corrugated produce containers are frequently configured such that, when stacked, channels are formed therebetween and thereinto in order to facilitate adequate ventilation of the produce contained therein and to insure effective control of the environment, i.e., temperature and humidity. Uppermost and lowermost longitudinal corners of the containers may be beveled in order to form air conduits in the region where four stacked containers abut. Apertures formed along the bevel of each container facilitate air flow from the conduit into the container. By utilizing the conduits formed by such bevels and apertures, the application of pesticides and the like or inert gasses reduces the likelihood of insect infestation and/or the growth of fungus. Two examples of contemporary containers having such bevels and apertures are those produced by Maxco, of Reedley, Calif. and those produced by Weyerhauser of Bakersfield, Calif.

However, in forming such bevels, the structural strength, i.e., the ability to withstand stacking, of the containers is substantially reduced and the problems associated with wetting of the containers is exacerbated. Thus, the use of such bevels to form conduits further decreases the useful life of corrugated cardboard containers.

Stacking alignment tabs are typically formed along the upper edge of each end member of the produce containers. The stacking alignment tabs are configured to be received within cut-outs formed along the lower edge of each of the containers in order to facilitate stacking thereof. When containers are stacked one atop another, the stacking alignment tabs of the lower container are positioned within the cut-outs of the upper container, thereby assuring proper alignment of the containers in order to form a straight vertical stack. This interlocking of adjacent containers also makes each stack more stable and thus less likely to topple over.

The storage life of produce stored within such containers is typically not limited by degradation of the fruit contained therein, but rather is often limited by the storage life of the corrugated cardboard containers themselves. Degradation of the corrugated cardboard containers due to handling and the absorption of moisture commonly prevents such containers from being used for extended periods of time.

In light of the problems associated with transporting and storing produce in corrugated cardboard containers, it is desirable that contemporary containers be improved in some manner so as to increase the structural strength thereof. It is important, however, that the means utilized to increase the strength of the corrugated cardboard containers not add significantly to the weight, bulk, or to the cost of manufacturing the containers. Thus, the design of such improved corrugated cardboard containers must lend itself to simple and inexpensive mass production techniques.

The improved containers should be as simple in design as possible and should be comprised of inexpensive materials. The entire container should be recyclable without the need to separate any portion of the container therefrom. By simplifying the design of the container, automation of the fabrication process is maximized and the cost associated therewith minimized.

Furthermore, it is desirable that the container resist degradation due to the presence of moisture. Thus, it is desirable that the strength of the materials utilized in the fabrication of the container not be affected by the absorption of moisture.

As such, although the prior art has recognized to a limited extent the problem of increasing the strength of corrugated cardboard containers, the proposed solutions, to date, have been ineffective in providing a satisfactory remedy.

SUMMARY OF THE INVENTION

The present invention addresses and alleviates the above-mentioned deficiencies associated with the prior art. More particularly, the present invention comprises an improved fruit and product container comprising a bottom and two side walls formed of a common piece of corrugated cardboard, and two end walls formed of laminated paperboard attached to the bottom and end walls so as to define a box. The use of laminated paperboard end walls enhances the stacking strength and moisture resistance of the container.

The container preferably further comprises two top flaps, one top flap formed at the upper end of each end wall such that each top flap and its associated end wall are formed of a common piece of laminated paperboard and such that the top flaps rest upon the side walls. A single piece of laminated paperboard is scored so as to define each top flap and its associated end wall. The top flaps enhance the stacking strength of the carton and also help maintain the contents of the carton therein while mitigating the introduction of undesirable debris. The top flaps also help prevent cartons stacked above from sliding into those stacked below.

The container preferably further comprises stacking alignment tabs extending upwardly from the end walls and formed of a common piece of laminated paperboard therewith.

The container preferably further comprises two side flaps formed upon each end wall, one side flap extending perpendicularly from each side of the end wall and attaching to a side wall, each side flap further enhancing the stacking strength of the container.

The container preferably further comprises a top which is removably attachable thereto. The top preferably comprises two openings formed therein and configured to receive the stacking alignment tabs. The stacking alignment tabs are preferably configured so as to engage the openings formed in the top in order to removably attach the top to the end walls. The stacking alignment tabs preferably comprise notches formed therein so as to receive portions of the periphery of the openings formed therein, so as to effect such removable attachment of the top to the end walls. The top preferably further comprises end flaps extending downwardly therefrom along the end walls.

The container preferably further comprises slots formed at perpendicular intersections of the bottom and side walls. Openings are preferably formed intermediate the stop and side walls. The slots cooperate with the openings of stacked boxes to form conduits which facilitate the introduction of desired gases into such stacked containers.

Forming the slots at the perpendicular intersection of the bottom and side walls further enhancing the stacking strength of the container by eliminating the beveled intersection of the bottom and side walls of prior art containers. Those skilled in the art will recognize that perpendicularly intersecting bottom and side walls possess substantially greater stacking strength than do beveled intersections.

The cartons are preferably configured to have lengths and widths which facilitate efficient stacking upon pallets. For example, the containers may optionally be configured to define a 4×5 carton array upon a conventional 40-inch by 48-inch pallet. A 5×4 carton array could then be stacked atop the 4×5 carton array and the stacking sequence then repeated, i.e., providing alternating stacked 4×5 and 5×4 carton arrays, so as to provide stable stacks.

These, as well as other, advantages of the present invention will be more apparent from the following description and drawings. It is understood that changes in the specific structure shown and described may be made within the scope of the claims without departing from the spirit of the invention.

DETAILED DESCRIPTION OF THE INVENTION

Figure 1:
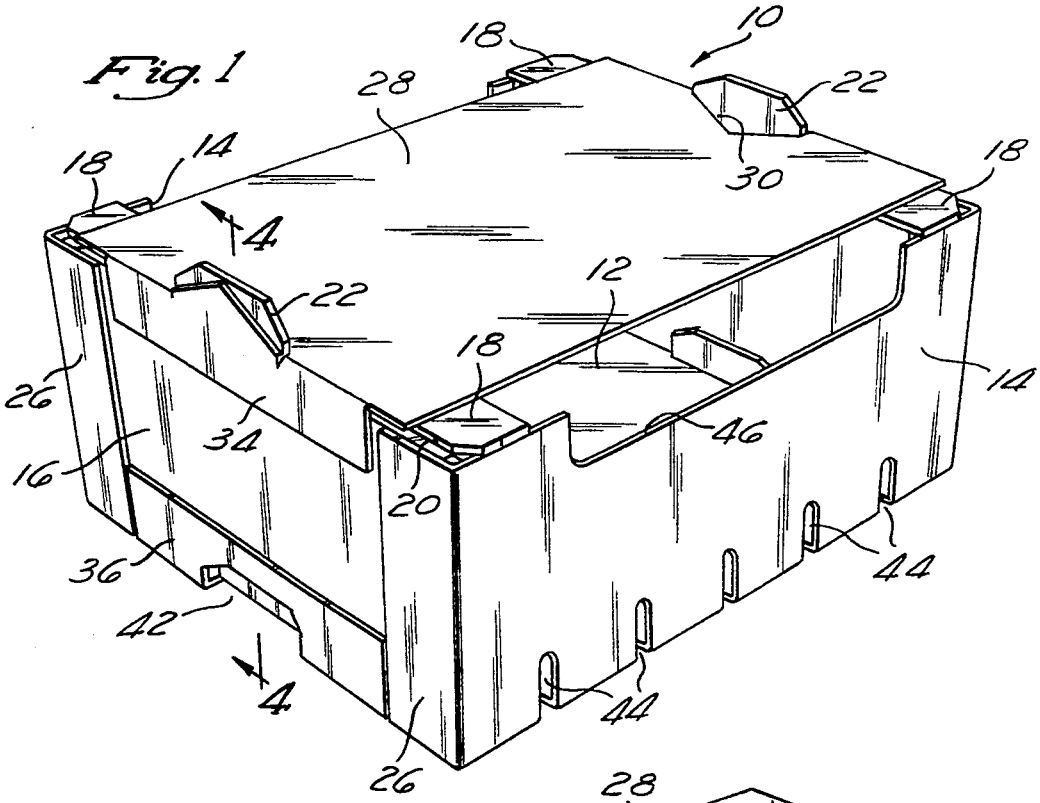
FIG. 1 is a perspective view of an improved fruit and produce container of the present invention.

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

The improved fruit and product container of the present invention is illustrated in FIGS. 1–7 which depict a presently preferred embodiment of the invention. Referring now to FIGS. 1–7, each improved fruit and produce container 10 is comprised generally of a bottom 12 and two side walls 14 formed of a common piece of corrugated cardboard. Two end walls 16 are formed of laminated paperboard attached to the bottom 12 and the side walls 14 so as to define a box. The two laminated paperboard end walls 16 substantially enhance the stacking strength and moisture resistance of the container.

One top flap 18 is formed at an upper end of each end wall 16 such that each top flap 18 and its associated end wall 16 are formed of a common piece of laminated paperboard and such that the top flaps rest upon the side walls 14.

In the preferred embodiment of the present invention a single piece of laminated paperboard comprises a score 20 so as to define the top flap 18 and its associated end wall 16. The score 20 preferably further defines stacking alignment tabs 22 extending upwardly from the end walls 16 and formed of a common piece of laminated paperboard therewith.

Two side flaps 24 (best shown in FIG. 3) are preferably formed upon each end wall 16, one side flap 24 extending perpendicularly from each side of the end wall 16 and attaching to a side wall 14 so as to further enhance the stacking strength of the container 10.

Similarly, two end flaps 26 are formed upon each side wall 14, one end flap 26 extending perpendicularly from each side of the side wall 14 and attaching to an end wall 16 so as to yet further enhance the stacking strength of the container 10.

An optional top 28 is removably attachable to the container 10. The top 28 preferably comprises two openings 30, one opening 30 formed at either end thereof and configured to receive a stacking alignment tab 22.

With particular reference to FIG. 1, the stacking alignment tabs 22 are preferably configured to engage the openings 30 of the top 28 so as to removably attach the top 28 to the end walls 16. The stacking alignment tabs 22 thus preferably comprise notches 32 (best shown in FIG. 7) formed therein so as to receive portions of the top 28 at the periphery of the openings 30 formed therein and thereby effect removable attachment of the top 28 to the end walls 16.

Figure 2:
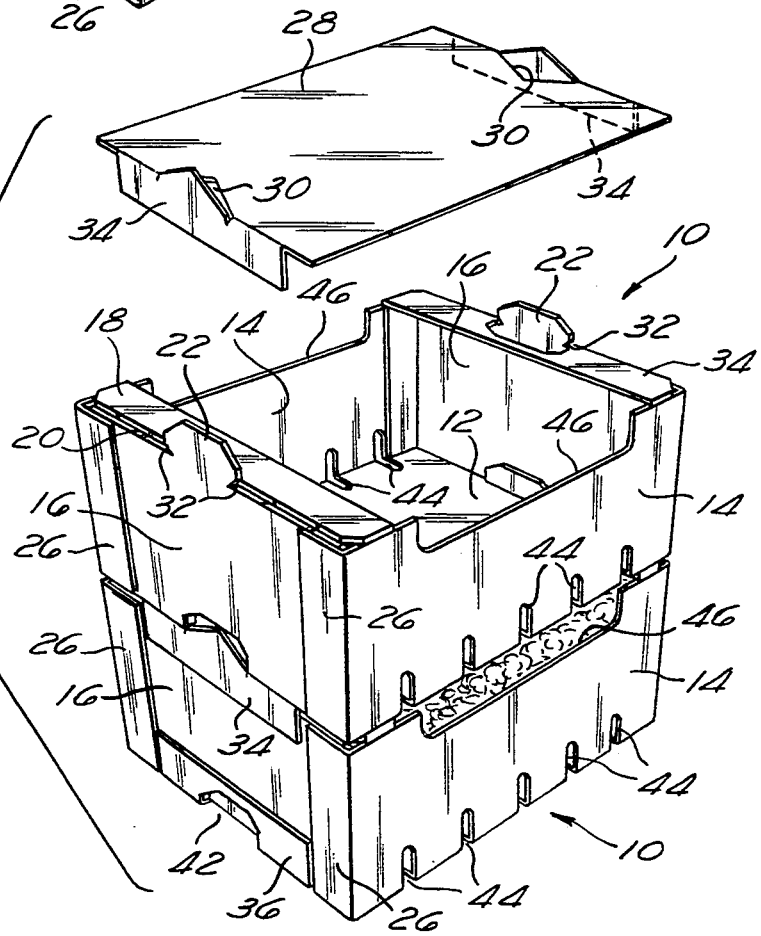
FIG. 2 is a perspective view of two stacked improved fruit and produce containers of the present invention showing the top exploded away from the upper improved fruit and produce container of the stack.

With particular reference to FIG. 2, the top 28 preferably further comprises end flaps 34 extending perpendicularly downwardly therefrom along the end walls 16.

Figure 3:
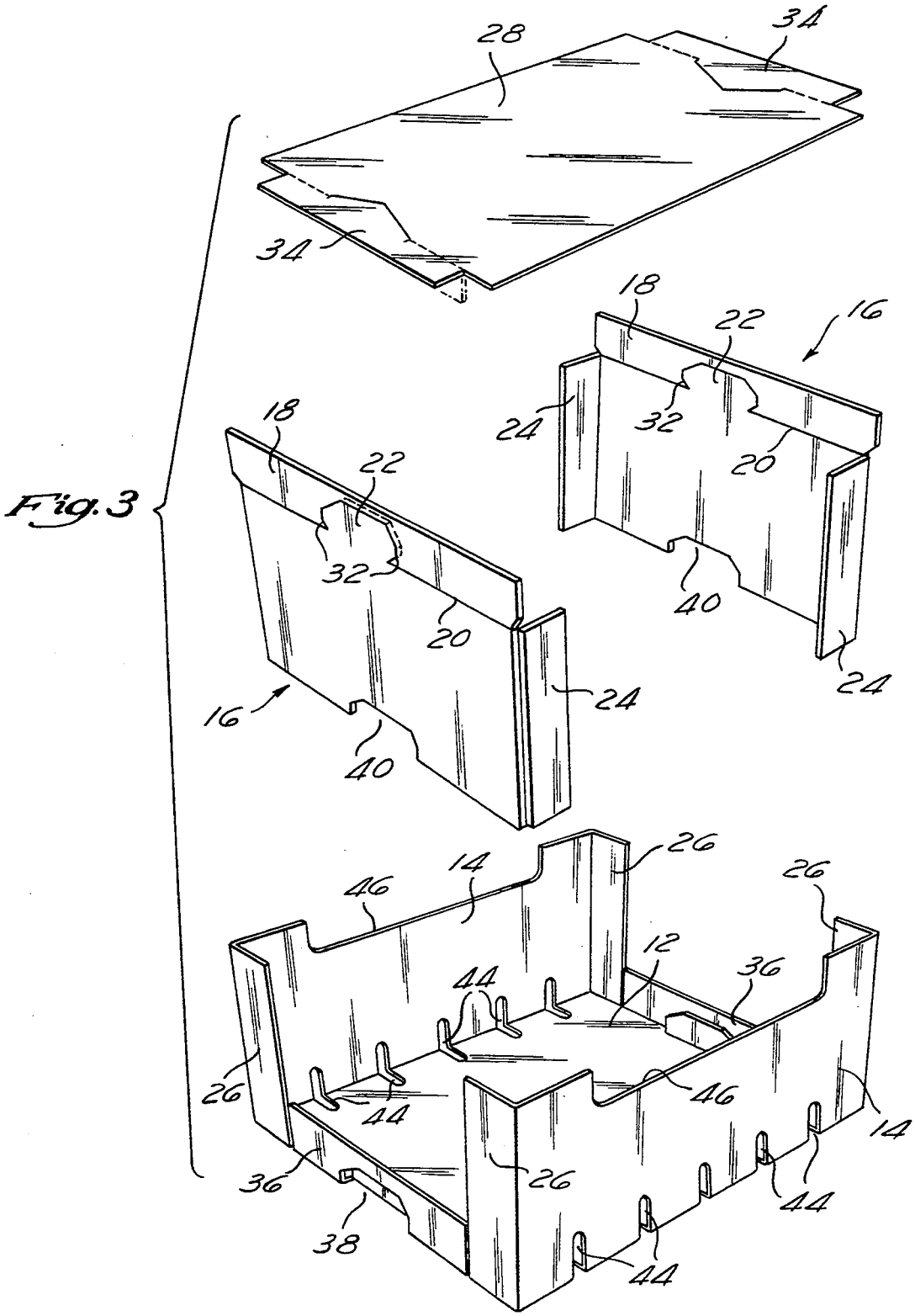
FIG. 3 is a perspective view of an exploded fruit and produce container of FIG. 1.
Figure 4:
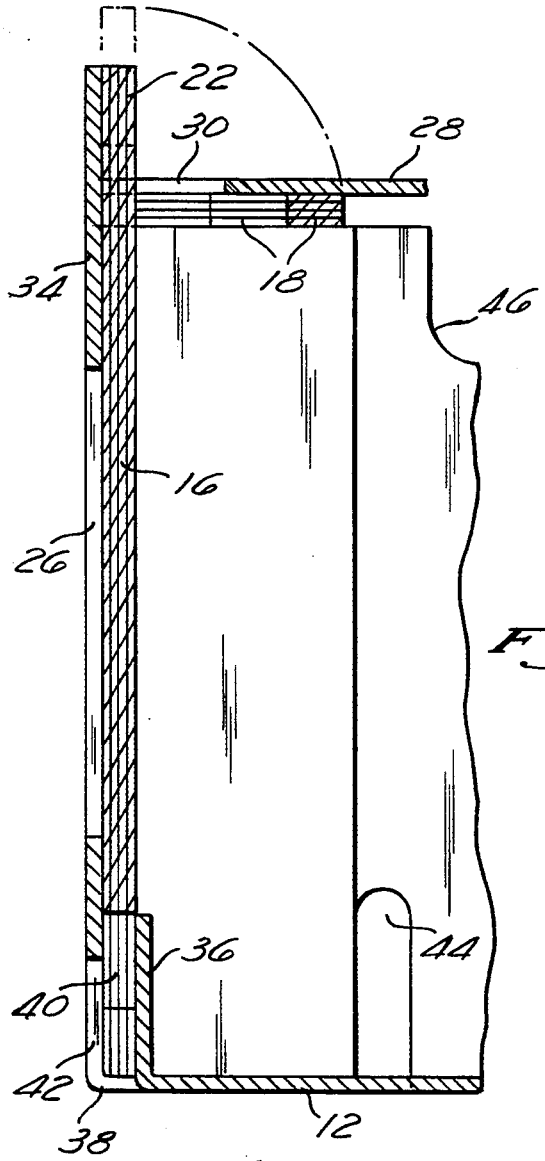
FIG. 4 is a cross-sectional side view taken along lines 4 of FIG. 1.
Figure 5:
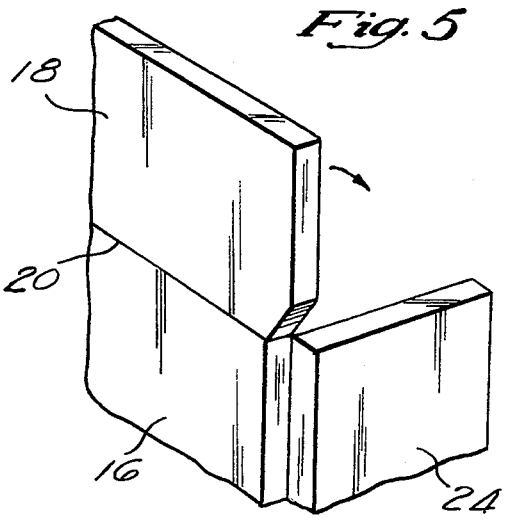
FIG. 5 is an enlarged perspective view of a portion of an end of the improved fruit and produce carton of FIG. 1 having a top flap formed thereon and attached to a side showing the top flap positioned vertically, prior to bending over thereof into its horizontal position.
Figure 6:
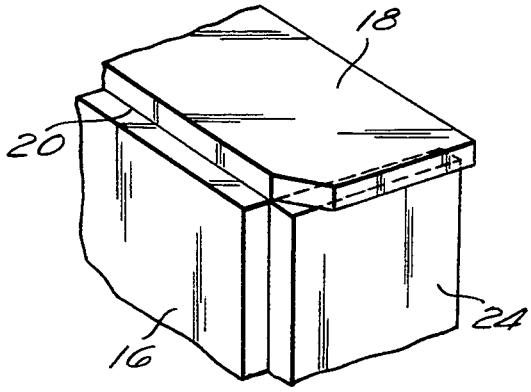
FIG. 6 is a perspective view of a portion of an end wall, top flap, and side wall of the improved fruit and product carton of FIG. 1 showing the top flap bent over into its horizontal portion.
Figure 7:
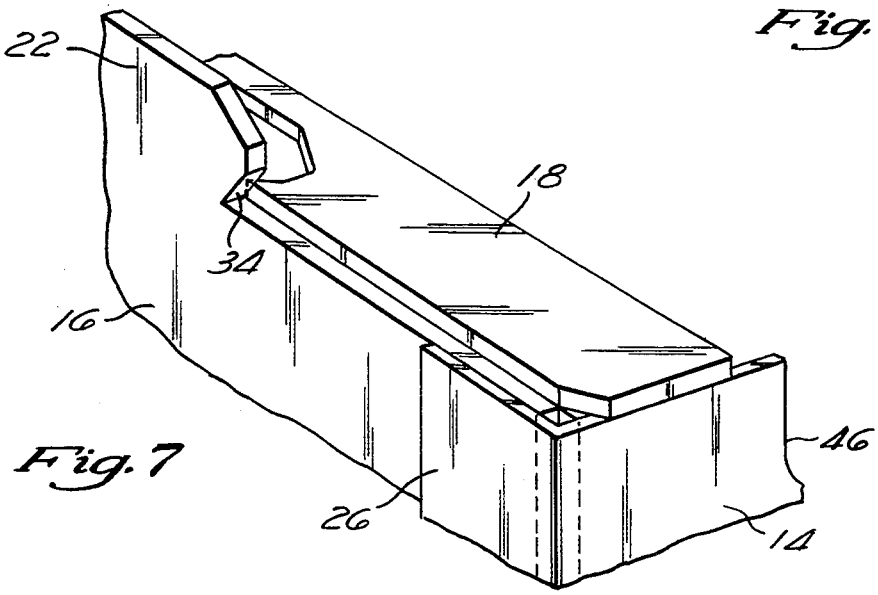
FIG. 7 is a fragmentary enlarged view of one end of the improved fruit and produce container of FIG. 1 showing a stacking alignment tab configured so as to removably attach the top to the container.

With particular reference to FIG. 3, the bottom 12 of the carton 10 preferably further comprises upwardly extending end flaps 36. Cutouts 38 formed at the intersection of the bottom 12 and the upwardly extending end flaps 36 and complimentary cutouts 40 formed in the end walls 16 define recesses 42 (as shown in FIGS. 1 and 2) for receiving the stacking alignment tabs 22 of inferiorly stacked cartons 10.

Each end wall 16, side flap 24, and top flap 18 is preferably adhesively bonded to corresponding portions of the floor's 12 upwardly extending end flap 36 thereof, side walls 14, and end flaps 26 so as to optimize the stacking strength of the improved fruit and produce carton of the present invention. Such adhesive bonding is preferably via hot glue, e.g., a heated polymer. Those skilled in the art will recognize that various other adhesive bonding materials are likewise suitable.

The container preferably further comprises slots 44 formed at the perpendicular intersections of the bottom 12 and the side walls 14 so as to facilitate the introduction of desired gases into the container 10. Forming the slots 44 at the perpendicular intersection of the bottom 12 and side walls 14 further enhances the stacking strength of the container 10. Openings or cutouts 46 formed intermediate the top 28 and side walls 14 cooperate with the slots so as to form conduits. The conduits facilitate the introduction of desired gases into the container 10 when a plurality of such containers 10 are stacked.

Thus, a balanced combination of corrugated cardboard and laminated paperboard cooperate so as to maximize stacking strength and moisture resistance while minimizing cost and weight of the container in the present invention.

It is understood that the exemplary improved fruit and produce container described herein and shown in the drawings represents only a presently preferred embodiment of the invention. Indeed, various modifications and additions may be made to such embodiment without departing from the spirit and scope of the invention. For example, those skilled in the art will recognize that various different configurations of the slots 44 and the cutout 46 are likewise suitable for forming conduits so as to facilitate the introduction of desired gases into the container 10. Also, various different complimentary shapes of the stacking alignment tabs 22 and the openings 30 of the top 28 are contemplated.

What is claimed is:

1. An improved fruit and produce container comprising:

a) a bottom and two side walls formed of a common piece of corrugated cardboard;

b) two end walls formed of laminated paperboard attached to said bottom and said side walls so as to define a box; and c) wherein said two laminated paperboard end walls enhance stacking strength and moisture resistance of the container.

2. The container as recited in claim 1 further comprising two top flaps, one of said top flaps formed at an upper end of each of said end walls such that each of said top flaps and its associated end wall are formed of a common piece of laminated paperboard and such that said top flaps rest upon said side walls.

3. The container as recited in claim 2 wherein a single piece of laminated paperboard is scored so as to define each of said top flaps and that flap's associated end wall.

4. The container as recited in claim 3 further comprising a stacking alignment tab extending upwardly from each of said end walls, each of said stacking alignment tabs being formed of a common piece of laminated paperboard with each of said end walls.

5. The container as recited in claim 1 further comprising two side flaps formed upon each of said end walls, one of said side flaps extending perpendicularly from each side of each of said end walls and attaching to one of said side walls, each of said side flaps further enhancing the stacking strength of the container.

6. The container as recited in claim 4 further comprising a top configured so as to be removably attachable to the container.

7. The container as recited in claim 6 wherein said top comprises two openings formed therein and configured to receive said stacking alignment tabs.

8. The container as recited in claim 7 wherein said stacking alignment tabs are configured to engage the openings formed with said top so as to removably attach said top to said end walls.

9. The container as recited in claim 8 wherein said stacking alignment tabs comprise notches formed therein so as to receive portions of said top at a periphery of each of the openings formed therein so as to effect removable attachment of said top to said end walls.

10. The container as recited in claim 6 wherein said top further comprises end flaps extending downwardly therefrom along said end walls.

11. The container as recited in claim 1 further comprising:

a) slots formed at perpendicular intersections of said bottom and said side walls, said slots facilitating the introduction of desired gases into said container; and b) wherein forming said slots at the perpendicular intersection of said bottom and said side walls further enhances the stacking strength of the container.

12. The container as recited in claim 6 further comprising:

a) slots formed at perpendicular intersections of said bottom and said side walls, said slots facilitating the introduction of desired gases into said container;

b) openings formed intermediate said top and said side walls; and c) wherein said slots cooperate with said openings to form conduits, said conduits facilitating the introduction of desired gases into said container.

13. A method for fabricating an improved fruit and produce container, said method comprising the steps of:

a) forming a bottom and two side walls from a common piece of corrugated cardboard;

b) forming two end walls of laminated paperboard;

c) attaching the two end walls to the bottom and side walls so as to define a box; and d) wherein said two laminated paperboard end walls enhance stacking strength and moisture resistance of the container.

14. The method as recited in claim 13 further comprising the step of forming a top flap at an upper end of each of said end walls such that each of said top flaps and its associated end wall are formed of a common piece of laminated paperboard and such that each of the top flaps rests upon the side walls.

15. The method as recited in claim 14 wherein the step of forming each of said top flaps comprises scoring a single piece of laminated paperboard so as to define each of said top flaps and its associated end wall.

16. The method as recited in claim 15 wherein the step of scoring each of said pieces of laminated paperboard comprises scoring each of said pieces of laminated paperboard so as to define a stacking alignment tab extending upwardly from each of said end walls, each of said stacking alignment tabs being formed of a common piece of laminated paperboard with said end walls.

17. The method as recited in claim 16 further comprising the steps of:

a) forming two side flaps upon each of said end walls, one of said side flaps extending perpendicularly from each side of said end walls; and b) attaching each of said side flaps to one of said side walls so as to further enhance the stacking strength of the container.

18. The method as recited in claim 17 further comprising the step of forming two openings in a top, the openings configured to receive the stacking alignment tabs.

19. The method as recited in claim 18 further comprising the steps of:

a) forming slots at perpendicular intersections of the bottom and side walls;

b) forming openings intermediate the top and side walls; and c) wherein said slots cooperate with said openings to form conduits, said conduits facilitating the introduction of desired gases into the container.

20. An improved fruit and produce container comprising:

a) a bottom and two side walls formed of a common piece of corrugated cardboard;

b) two end walls formed of laminated paperboard attached to said bottom and said side walls so as to define a box;

c) slots formed at perpendicular intersections of said bottom and said side walls, said slots facilitating the introduction of desired gases into said container;

d) openings formed intermediate said top and said side walls;

e) wherein said two laminated paperboard end walls enhance stacking strength and moisture resistance of the container; and f) wherein said slots cooperate with said openings to form conduits, said conduits facilitating the introduction of desired gases into said container.

21. The container as recited in claim 20 further comprising two top flaps, one of said top flaps formed at an upper end of each of said end walls such that each of said top flaps and its associated end wall are formed of a common piece of laminated paperboard and such that said top flaps rest upon said side walls.

22. The container as recited in claim 21 wherein a single piece of laminated paperboard is scored so as to define each of said top flaps and that flap's associated end wall.

23. The container as recited in claim 22 further comprising a stacking alignment tab extending upwardly from each of said end walls, each of said stacking alignment tabs being formed of a common piece of laminated paperboard with each of said end walls.

24. The container as recited in claim 20 further comprising two side flaps formed upon each of said end walls, one side flap extending perpendicularly from each side of each of said end walls and attaching to one of said side walls, each of said side flaps further enhancing the stacking strength of the container.

25. The container as recited in claim 20 further comprising a top configured so as to be removably attachable to the container.

26. The container as recited in claim 20 wherein said top comprises two openings formed therein and configured to receive said stacking alignment tabs.

27. The container as recited in claim 26 wherein said stacking alignment tabs are configured to engage the openings formed with said top so as to removably attach said top to said end walls.

28. The container as recited in claim 27 wherein said stacking alignment tabs comprise notches formed therein so as to receive portions of said top at a periphery of each of the openings formed therein so as to effect removable attachment of said top to said end walls.

29. The container as recited in claim 25 wherein said top further comprises end flaps extending downwardly therefrom along said end walls.

30. A method for fabricating an improved fruit and product container, said method comprising the steps of:

a) forming a bottom and two side walls from a common piece of corrugated cardboard;

b) forming two end walls of laminated paperboard;

c) attaching the two end walls to the bottom and side walls so as to define a box;

d) forming slots at perpendicular intersections of the bottom and side walls;

e) forming openings intermediate the top and side walls;

f) wherein said two laminated paperboard end walls enhance stacking strength and moisture resistance of the container; and g) wherein said slots cooperate with said openings to form conduits, said conduits facilitating the introduction of desired gases into the container.

31. The method as recited in claim 30 further comprising the step of forming a top flap at an upper end of each of said end walls such that each of said top flaps and its associated end wall are formed of a common piece of laminated paperboard and such that each of the top flaps rests upon the side walls.

32. The method as recited in claim 31 wherein the step of forming each of said top flaps comprises scoring a single piece of laminated paperboard so as to define each of said top flaps and its associated end wall.

33. The method as recited in claim 32 wherein the step of scoring each of said pieces of laminated paperboard comprises scoring laminated paperboard so as to define a stacking alignment tab extending upwardly from each of said end walls, each of said stacking alignment tabs being formed of a common piece of laminated paperboard with said end walls.

34. The method as recited in claim 33 further comprising the steps of:

a) forming two side flaps upon each of said end walls, one of said side flaps extending perpendicularly from each side of said end walls; and b) attaching each of said side flaps to one of said side walls so as to further enhance the stacking strength of the container.

35. The method as recited in claim 34 further comprising the step of forming two openings in a top, the openings configured to receive the stacking alignment tabs.

* * * * *